US008647112B2

(12) United States Patent
Huang et al.

(10) Patent No.: US 8,647,112 B2
(45) Date of Patent: Feb. 11, 2014

(54) COMBUSTOR ASSEMBLY OF WATER HEATER

(75) Inventors: Chung-Chin Huang, Taichung (TW); Chin-Ying Huang, Taichung (TW); Hsin-Ming Huang, Taichung (TW); Hsing-Hsiung Huang, Taichung (TW); Kuan-Chou Lin, Taichung (TW)

(73) Assignee: Grano Mate Co., Ltd., Taichung (TW)

( * ) Notice: Subject to any disclaimer, the term of this patent is extended or adjusted under 35 U.S.C. 154(b) by 502 days.

(21) Appl. No.: 12/797,499

(22) Filed: Jun. 9, 2010

(65) Prior Publication Data

US 2011/0256490 A1 Oct. 20, 2011

(30) Foreign Application Priority Data

Apr. 14, 2010 (TW) ..... 99206759 U

(51) Int. Cl.
*F23M 3/04* (2006.01)
*F23D 14/14* (2006.01)

(52) U.S. Cl.
USPC ..... 431/181; 431/10; 431/202; 431/354; 122/17.1; 126/615

(58) Field of Classification Search
USPC ..... 431/10, 12, 181, 183, 285, 349, 350, 431/351, 354; 122/17.1, 17.2; 126/615
See application file for complete search history.

(56) References Cited

U.S. PATENT DOCUMENTS

| | | | | |
|---|---|---|---|---|
| 5,423,675 | A * | 6/1995 | Kratsch | 431/328 |
| 5,937,796 | A * | 8/1999 | Sebastiani | 122/18.31 |
| 6,216,643 | B1 * | 4/2001 | Reynolds et al. | 122/13.01 |
| 6,422,178 | B1 * | 7/2002 | Lannes et al. | 122/14.31 |
| 6,698,385 | B1 * | 3/2004 | Lesage | 122/13.01 |
| 6,916,175 | B2 * | 7/2005 | Cho et al. | 431/354 |
| 8,011,360 | B2 * | 9/2011 | Desi-Seulean et al. | 126/116 R |
| 2001/0027756 | A1 * | 10/2001 | Vago | 122/18.2 |
| 2003/0196609 | A1 * | 10/2003 | Stretch et al. | 122/17.1 |
| 2004/0126727 | A1 * | 7/2004 | Cho et al. | 431/354 |
| 2005/0235984 | A1 * | 10/2005 | Trihey et al. | 126/615 |
| 2009/0255487 | A1 * | 10/2009 | Hicks et al. | 122/13.01 |
| 2010/0294214 | A1 * | 11/2010 | Lee | 122/17.1 |
| 2011/0067650 | A1 * | 3/2011 | Chung-Chin et al. | 122/18.2 |

FOREIGN PATENT DOCUMENTS

| | | | | |
|---|---|---|---|---|
| JP | 2001090913 A * | 4/2001 | | F23D 14/62 |
| WO | WO 2006019279 A1 * | 2/2006 | | F23D 14/14 |

* cited by examiner

*Primary Examiner* — Steven B McAllister
*Assistant Examiner* — Desmond C Peyton
(74) *Attorney, Agent, or Firm* — Tracy M. Heims; Apex Juris, PLLC

(57) ABSTRACT

A combustor assembly of a water heater, which is provided between an air blower and a burner set to guide air from the air blower to the burner set, includes a first board, a second board and a third board stacked in sequence. Between the first board and the second board there is a first chamber and a first port, and between the second board and the first board there is a second chamber and a second port. The second board and the third board both have apertures. These boards restrict and divide an air flow of the air blower to flow along several paths to increase heat efficiency.

2 Claims, 6 Drawing Sheets

COMBUSTOR ASSEMBLY OF WATER HEATER

BACKGROUND OF THE INVENTION

1. Field of the Invention

The present invention relates generally to a water heater, and more particularly to a combustor assembly of a water heater.

2. Description of the Related Art

A conventional water heater equipped with a forced intake/exhaust device can raise heat efficiency with the intake device, and improve safety by exhausting waste gas outdoors after burning with the exhaust device. Typically, the water heater is fixed with an air blower at a bottom thereof to force air flowing into the water heater, and then the air is mixed with gas from a gas valve nearby the air blower in a burner for burning. The air blower may raise the heat efficiency; however, the air blower is too close to the gas valve that an air flow from the air blower will blow the gas away. As a result, there may not be enough gas in the burner and may generate too much carbon monoxide, which is fatal to human.

SUMMARY OF THE INVENTION

The primary objective of the present invention is to provide a combustor assembly of a water heater, in which air flow is divided properly and well mixed with gas to raise the heat efficiency.

According to the objective of the present invention, a combustor assembly of a water heater is provided between an air blower and a burner set to guide air from the air blower to the burner set. The combustor assembly includes a first board including an opening; a second board stacked on the first board to form a first chamber and a first port between the first board and the second board, wherein the first port is at an end of the first chamber and communicated with the first chamber, and the second board has a plurality of apertures communicated with the first chamber; and a third board stacked on the second board to form a second chamber, wherein the third board has a plurality of apertures communicated with the second chamber. The air blower supplies an air flow to the combustor assembly via the opening of the first board, and the air flow is divided to flow along a first path and a second path, wherein the first path goes through the first chamber and the first port in sequence, and the second path goes through the first chamber, the apertures of the second board, the second chamber, and the apertures of the third board in sequence.

DETAILED DESCRIPTION OF THE INVENTION

Figure 1:
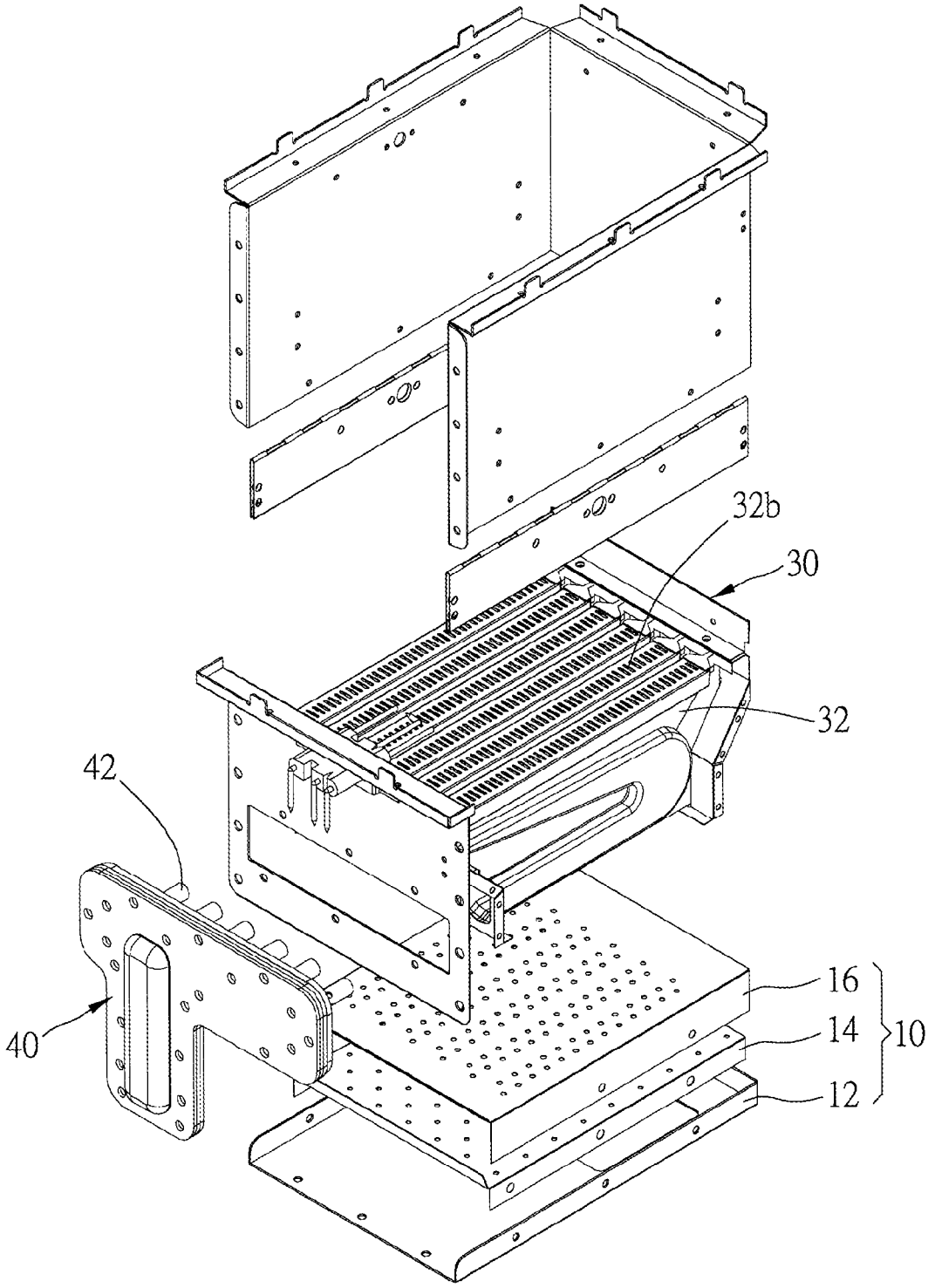
FIG. 1 is an exploded view of the combustor assembly and the burner set of a preferred embodiment of the present invention.
Figure 2:
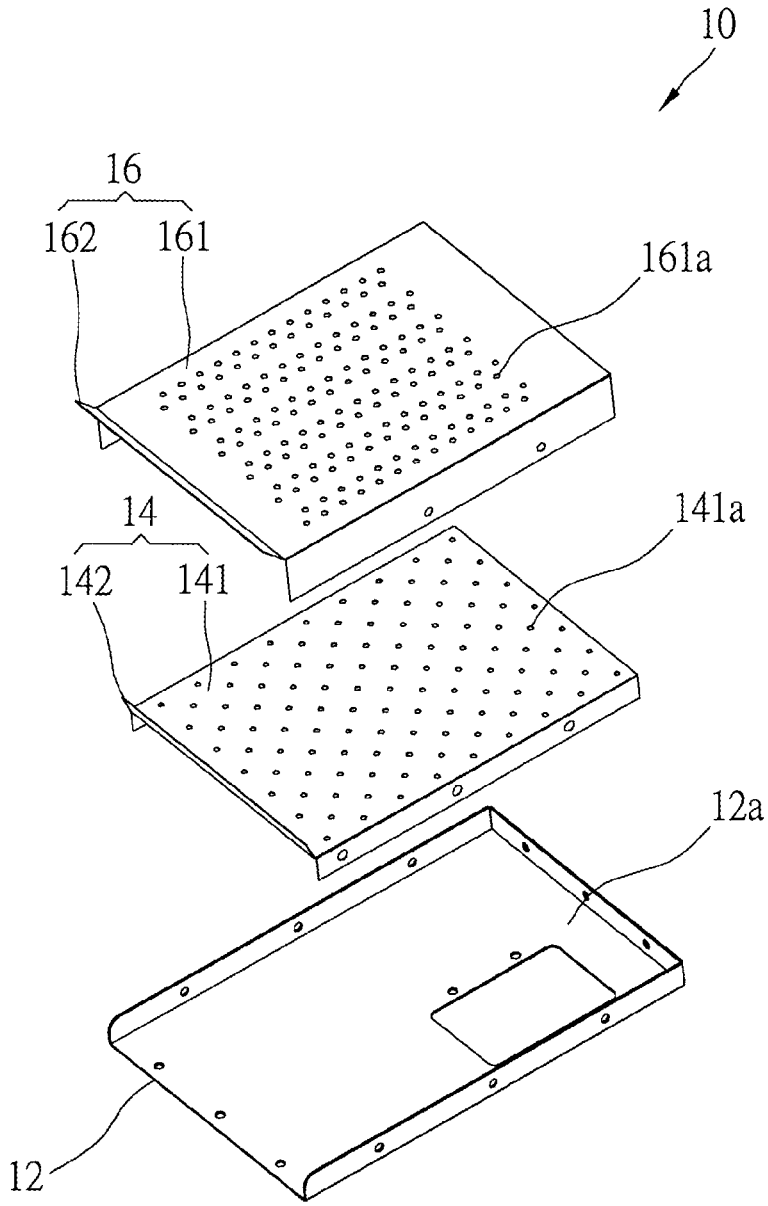
FIG. 2 is an exploded view of the combustor assembly of the preferred embodiment of the present invention.
Figure 3:
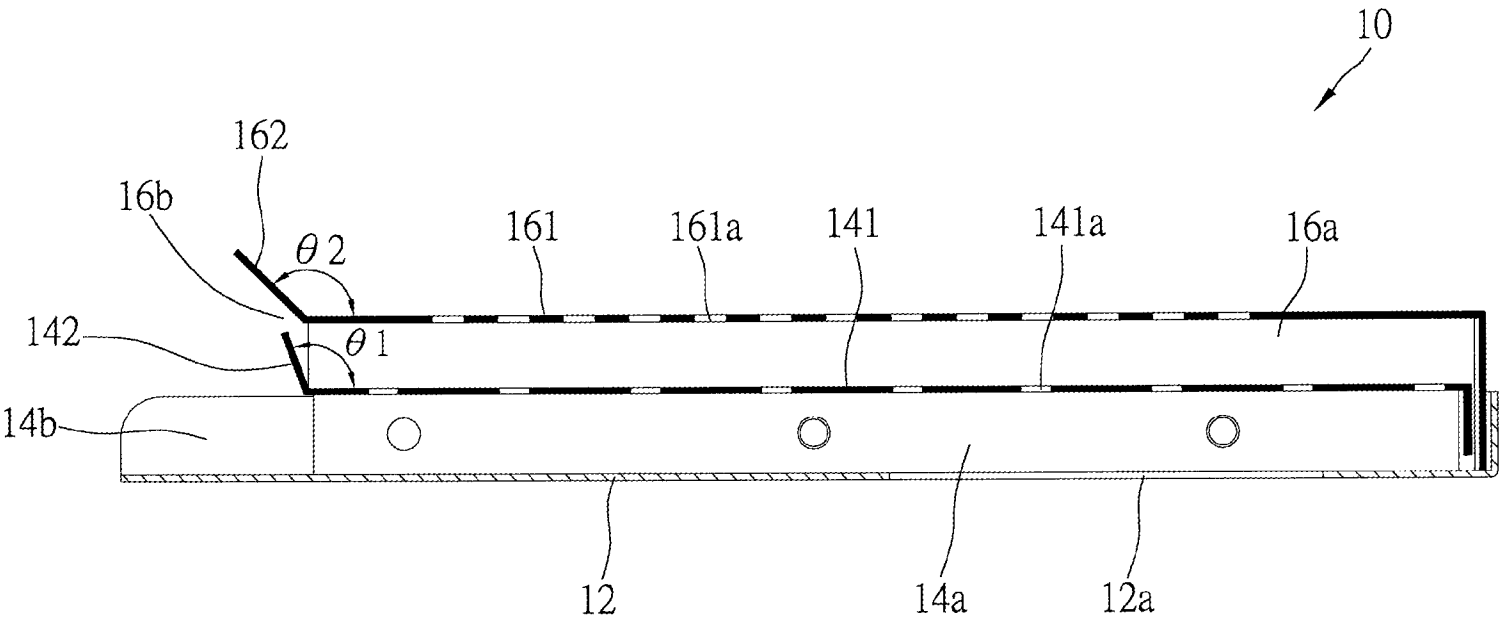
FIG. 3 is a sectional view of the combustor assembly of the preferred embodiment of the present invention.

As shown from FIG. 1 to FIG. 4, a combustor assembly 10 of the preferred embodiment of the present invention is provided in a water heater between an air blower 20 and a burner set 30. The air blower 20 has an outlet 22 pointing to the combustor assembly 10. The burner set 30 includes a plurality of burners 32, each of which includes a mixing chamber 32*a* therein and a plurality of flame openings 32*b* on a top thereof. A gas valve 40 is provided on a side of the burner set 30 which has a nozzle 42 extending into the mixing chamber 32*a* to fill gas into the burner set 32.

The combustor assembly 10 includes a first board 12, a second board 14 and a third board 16.

The first board 12 is close to the air blower 20 with an opening 12*a* connected to the outlet 22 of the air blower 20.

The second board 14 is stacked on the first board 12 to from the first board 12 to form a first chamber 14*a* and a first port 14*b* therebetween. The first port 14*b* is at an end of the first chamber 14*a* and adjacent to the gas valve 40. The second board 14 includes a plate 141 and a guiding plate 142. The plate 141 has a plurality of apertures 141 a communicated with the first chamber 14*a*. The guiding plate 142 is at an end of the plate 141 and is tilted upward to form a first angle θ1 therebetween. The first angle θ1 is an obtuse angle.

The third board 16 is stacked on the second board 14 to form a second chamber 16*a* and a second port 16*b* therebetween. The second port 16*b* is at an end of the second chamber 16*a* where the guiding plate 142 is tilted. The third board 16 includes a plate 161 and a stop plate 162. The plate 161 has a plurality of apertures 161*a* communicated with the second chamber 16*a*. The stop plate 162 is at an end of the plate 161 and is tilted upward to form a second angleθ2 therebetween. The second angleθ2 is an obtuse angle also and is greater than the first angle θ1. In other words, the stop plate 162 is less vertical than the guiding plate 142.

In addition, a density of the apertures 161*a* of the third board 16 is greater than a density of the apertures 141*a* of the second board 14.

Figure 4:
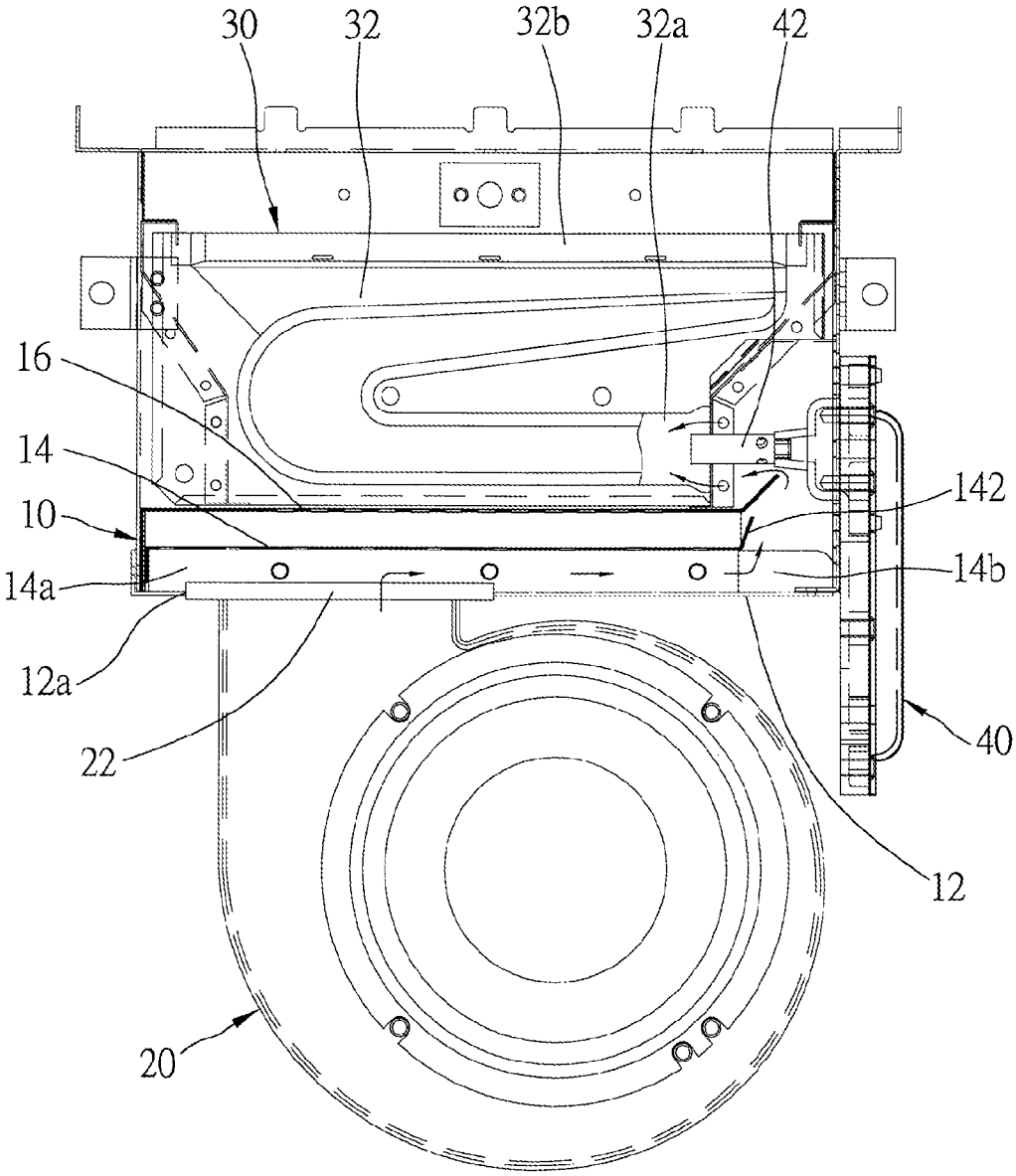
FIG. 4 is a sketch diagram of the combustor assembly, the burner set, and the air blower of the preferred embodiment of the present invention, showing the first path of the air flow.

Above are the elements of the combustor assembly of the present invention, and its function is described hereunder:

FIG. 4 shows a first path as indicated by arrows. The first path begins with the opening 12*a* of the first board 12, and goes to the first chamber 14*a* and the first port 14*b* in sequence. Air along the first path is called first air. The first air flows into the mixing chamber 32*a* of the burners 32 to be mixed with the gas from the gas valve 40. The first air supplies the majority of oxygen for burning.

Figure 5:
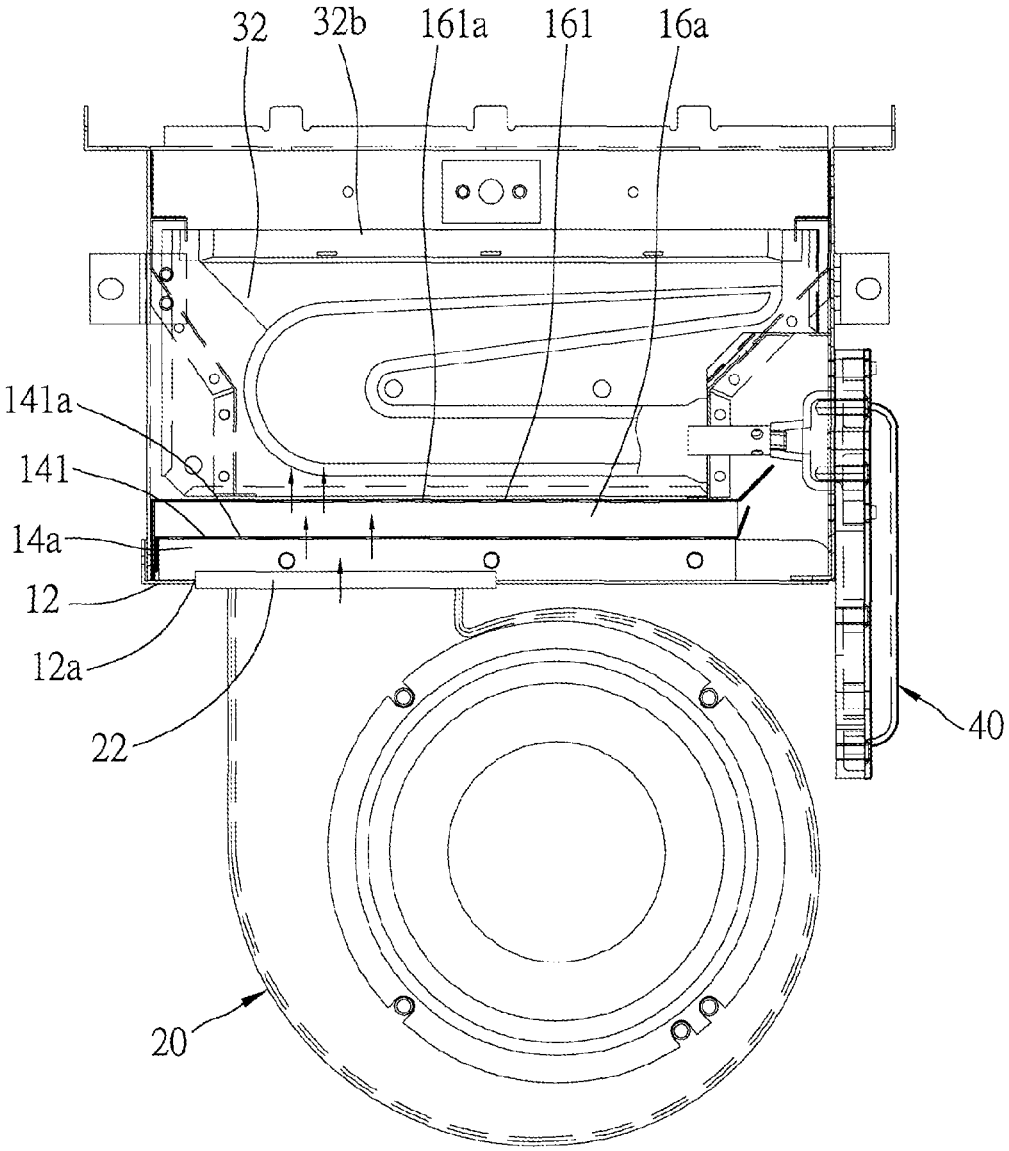
FIG. 5 is similar to FIG. 4, showing the second path of the air flow.

FIG. 5 shows a second path as indicated by arrows. The second path begins with the opening 12*a* of the first board 12 also, and goes to the first chamber 14*a*, the apertures 141 a of the second board 14, the second chamber 16*a*, and the apertures 161*a* of the third board 16 in sequence. Air along the second path flows to the flame openings 32*b* of burners 32 through gaps between the burners 32.

Figure 6:
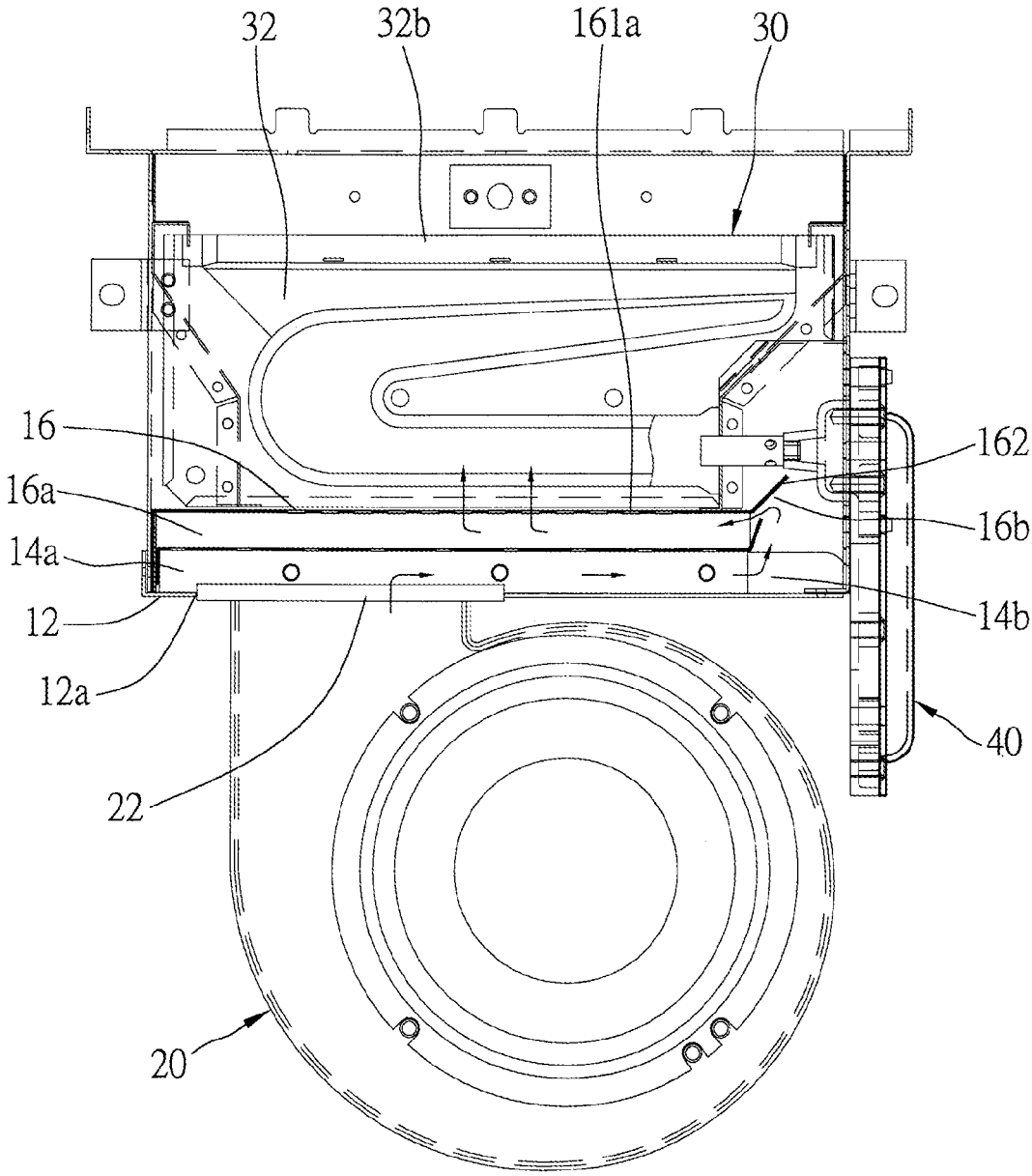
FIG. 6 is similar to FIG. 4, showing the third path of the air flow.

FIG. 6 shows a third path as indicated by arrows. The third path begins with the opening 12*a* of the first board 12 also, and goes to the first chamber 14*a*, the first port 14*b*, the second port 16*b*, the second chamber 16*a*, and the apertures 161*a* of the third board 16 in sequence. After the apertures 161*a* of the third board 16, air goes upward directly to the flame openings 32*b* of burners 32. The air along the second path and the third path is called second air. The second air supplies oxygen for burning at the flame openings 32*b*.

In conclusion, the air blower 20 supplies air into the water heater, and the air flow is restricted and divided by the boards into three, i.e. the first path, the second path, and the third path that the water heater of the present invention has no drawback as the conventional water heater that air may blow the gas away. The first air is well mixed with the gas in the mixing chamber. Besides, the board may reduce impacts of the air flow caused by the air blower 20. The second air supplies oxygen at the flame openings 32*b* that may help burning and increase the heat efficiency and reduce carbon monoxide.

The description above is a few preferred embodiments of the present invention. These equivalences of the present invention are still in the scope of claim construction of the present invention.

What is claimed is:

1. A combustor assembly of a water heater, which is provided between an air blower and a burner set to guide air from the air blower to the burner set, comprising:

a first board including an opening;

a second board stacked on the first board to form a first chamber and a first port between the first board and the second board, wherein the first port is at an end of the first chamber and communicated with the first chamber, and the second board has a plurality of apertures communicated with the first chamber; and a third board stacked on the second board to form a second chamber, wherein the third board has a plurality of apertures communicated with the second chamber;

wherein the air blower supplies an air flow to the combustor assembly via the opening of the first board, and the air flow is divided to flow along a first path and a second path, wherein the first path goes through the first chamber and the first port in sequence, and the second path goes through the first chamber, the apertures of the second board, the second chamber, and the apertures of the third board in sequence;

wherein between the second board and the third board there forms a second port communicated with the second chamber and communicated with the first port also that a third path for the air flow is formed along the first chamber, the first port, the second port, the second chamber, and the apertures of the third board in sequence;

wherein the second board has a plate and an upward guiding plate at an end of the plate that a first angle, which is an obtuse angle, is formed between the plate and the guiding plate, and the second port is formed between a distal end of the guiding plate and the third board;

wherein the third board has a plate and an upward stop plate at an end of the plate end of the plate that a second angle, which is an obtuse angle, is formed between the plate and the stop plate and the second angle is greater than the first angle; whereby the gas flow is blocked by the stop plate of the third board to guide the gas flow flowing into the second chamber via the second port;

wherein the first board, the second board and the third board are under a nozzle of a gas valve.

2. The combustor assembly as defined in claim 1, wherein a density of the apertures of the third board is greater than a density of the apertures of the second board.

* * * * *